US007784417B2

(12) United States Patent
Jensen

(10) Patent No.: US 7,784,417 B2
(45) Date of Patent: Aug. 31, 2010

(54) SAILBOAT WITH A CANTING BALLAST SYSTEM

(76) Inventor: Christian H. Jensen, 933 Sheridan Rd., Wilmette, IL (US) 60091

( * ) Notice: Subject to any disclaimer, the term of this patent is extended or adjusted under 35 U.S.C. 154(b) by 175 days.

(21) Appl. No.: 12/270,487

(22) Filed: Nov. 13, 2008

(65) Prior Publication Data

US 2010/0116189 A1 May 13, 2010

(51) Int. Cl.
*B63B 41/00* (2006.01)

(52) U.S. Cl. ..... 114/143

(58) Field of Classification Search ..... 114/140–143, 114/121, 122, 124
See application file for complete search history.

(56) References Cited

U.S. PATENT DOCUMENTS

| | | | |
|---|---|---|---|
| 559,983 | A | 5/1896 | McLean |
| 704,685 | A | 7/1902 | Jensen |
| 1,924,871 | A | 8/1933 | Ludington |
| 2,991,749 | A | 7/1961 | Patterson |
| 3,324,815 | A | 6/1967 | Morales |
| 3,595,190 | A | 7/1971 | Lapworth |
| 3,972,300 | A | 8/1976 | Adamski |
| 3,985,106 | A | 10/1976 | Ross |
| 4,016,824 | A | 4/1977 | Thyvold |
| 4,044,703 | A | 8/1977 | Kurtz |
| 4,058,076 | A | 11/1977 | Danahy |
| 4,074,646 | A | 2/1978 | Dorfman et al. |
| 4,089,286 | A | 5/1978 | Scheel |
| 4,094,263 | A | 6/1978 | Marcil |
| 4,117,797 | A | 10/1978 | Kelly et al. |
| 4,352,335 | A | 10/1982 | Sugden |
| 4,376,416 | A | 3/1983 | Carver |
| 4,377,124 | A | 3/1983 | Guigan |
| 4,421,492 | A | 12/1983 | Leva |

(Continued)

FOREIGN PATENT DOCUMENTS

| | | | |
|---|---|---|---|
| DE | 7830637 | U | 2/1979 |

(Continued)

OTHER PUBLICATIONS

Projectsomewhere Website: Alinghi has a bendy keel? Apr. 19, 2007, 1 page, http://www.projectsomewhere.com/2007/04/19/alinghi-has-a-bendy=keel/.

*Primary Examiner*—Daniel V Venne
(74) *Attorney, Agent, or Firm*—Beem Patent Law Firm

(57) ABSTRACT

A sailboat includes a canting ballast system configured to rotate with respect to a hull. The sailboat includes the hull having a port side and a starboard side, and an external surface. An arcuate member is coupled to the starboard and port sides extending above the hull. The canting ballast system includes at least one rotatable member coupled to the external surface and to the arcuate member. The system further includes a first strut having a first end and a second end, and a second strut having a first end and a second end wherein the first ends are coupled to the rotatable member. The system also includes at least one ballast. The second ends are coupled to the ballast such that an angle is defined between the first and second struts. The sailboat also includes a drive system coupled to the canting ballast system wherein the at least one drive system is configured to rotate the canting ballast system with respect to the hull.

14 Claims, 10 Drawing Sheets

U.S. PATENT DOCUMENTS

| | | | | |
|---|---|---|---|---|
| 4,500,056 | A | | 2/1985 | Della-Moretta |
| 4,638,755 | A | * | 1/1987 | Butka ..... 114/91 |
| 4,686,922 | A | | 8/1987 | Burroughs |
| 4,686,923 | A | | 8/1987 | Greene |
| 4,703,708 | A | | 11/1987 | Cohen |
| 4,722,292 | A | | 2/1988 | Marino et al. |
| 4,817,550 | A | | 4/1989 | Gutsche |
| 4,825,795 | A | | 5/1989 | Slemmons |
| 4,854,904 | A | | 8/1989 | Wahl |
| 4,945,845 | A | | 8/1990 | Johnson, Jr. |
| 5,009,178 | A | | 4/1991 | Geffken |
| 5,063,377 | A | | 11/1991 | Smith |
| 5,069,648 | A | | 12/1991 | Ozeki |
| 5,072,682 | A | | 12/1991 | Rodriguez Urroz et al. |
| 5,152,238 | A | | 10/1992 | Page |
| 5,163,377 | A | | 11/1992 | Calderon et al. |
| 5,199,368 | A | | 4/1993 | Souda |
| 5,280,760 | A | | 1/1994 | Edwards |
| 5,445,099 | A | | 8/1995 | Rendina |
| 5,509,368 | A | | 4/1996 | Ward |
| 5,533,462 | A | | 7/1996 | Parsons |
| D373,156 | S | | 8/1996 | Kirby |
| 5,622,130 | A | | 4/1997 | Calderon et al. |
| 5,848,574 | A | | 12/1998 | Lande |
| 5,896,825 | A | | 4/1999 | Trefethen |
| 5,908,005 | A | | 6/1999 | Everett |
| 5,967,074 | A | | 10/1999 | Frantl et al. |
| 6,019,059 | A | | 2/2000 | Kelsey |
| 6,032,603 | A | | 3/2000 | Olcott |
| 6,058,867 | A | | 5/2000 | Ettel |
| 6,089,173 | A | | 7/2000 | Lande |
| 6,257,159 | B1 | | 7/2001 | Siegmann |
| 6,453,836 | B1 | | 9/2002 | Ditmore |
| 6,499,419 | B1 | | 12/2002 | Bussard |
| 6,694,907 | B1 | | 2/2004 | Muldoon |
| 6,789,489 | B1 | | 9/2004 | Phipps |
| 6,886,481 | B1 | | 5/2005 | Lord |
| 6,951,180 | B2 | | 10/2005 | Robinson et al. |
| 7,128,010 | B2 | | 10/2006 | Robinson et al. |
| 7,165,501 | B2 | | 1/2007 | Woomer |
| 2003/0106477 | A1 | | 6/2003 | Hood et al. |
| 2004/0194683 | A1 | | 10/2004 | Bianchi |
| 2004/0206287 | A1 | | 10/2004 | Robinson et al. |
| 2005/0172878 | A1 | | 8/2005 | Jenkins |
| 2007/0000422 | A1 | | 1/2007 | Bianchi |

FOREIGN PATENT DOCUMENTS

| | | | |
|---|---|---|---|
| DE | 4229101 | | 3/1994 |
| EP | 1741624 | A1 | 1/2007 |
| FR | 2323574 | | 4/1977 |
| WO | WO2006/008418 | | 1/2006 |

* cited by examiner

SAILBOAT WITH A CANTING BALLAST SYSTEM

BACKGROUND OF THE INVENTION

1. Field of the Invention

The present invention is directed to a sailboat with a canting ballast system, mountable or integrated on the sailboat such as a racing and performance yacht, for increasing performance of the sailboat without compromising safety.

2. Description of the Related Art

Sailing yacht design has evolved over time to increase sailing yacht performance by changing various factors that influence sailing performance—especially increased righting moment and lower hydrodynamic drag. Righting moment is an essential part of the performance of racing and cruising sailing yachts as it directly affects the amount of sail that can be carried and in turn the driving power available.

Through this evolution, sailing yachts have developed from bilge ballast to long keeled to fin keeled to bulb keel to canting ballast designs. The various evolutions have continually increased the righting moment while decreasing the drag.

A few known canting ballast systems and foils provide better control of the yacht. However, these few known canting keels that include a ballast and a strut may only be canted up to 50 degrees to both port and starboard sides. The canting of the ballast often results in a big increase of the available righting moment, and as such, the keels are subjected to a large bending moment which may cause metal fatigue and/or structural failure of the struts. When a strut is fatigued, the effectiveness of the canting keel may be reduced and/or ineffective.

Further, at least one known canting strut of a ballast system extends through an opening in the bottom of the hull which may cause leaks in the bottom of the boat. Various leak proofing solutions have been developed to prevent leaks. However, the leak proofing solutions are difficult to utilize, many times do not prevent leaks, and may completely fail.

Additionally, a few known canting ballast systems may encounter various hydraulic, mechanical, and/or electrical complications that may disable the canting mechanism. A disabled canting mechanism may lead to free swinging keels which may lead to partial structural failure of the hull. About ⅓ of racing and performance yachts built with canting keels have experienced canting ballast system failures which results in significant financial loss. Further, a disabled canting ballast system severely limits the performance and/or seaworthiness of the yacht and often results in the yacht withdrawing from races and/or terminating passages.

What is needed is a durable, efficient, reliable, and productive canting ballast system for a sailing yacht that increases righting moment to increase performance of the sailing yacht.

BRIEF SUMMARY OF THE INVENTION

In one embodiment, a sailboat includes a canting ballast system configured to rotate with respect to a hull. The sailboat may include the hull having a port side and a starboard side, and an external surface. An arcuate member may be coupled to the starboard and port sides extending above the hull. The canting ballast system may include at least one rotatable member coupled to the external surface and to the arcuate member. The system further may include a first strut having a first end and a second end, and a second strut having a first end and a second end wherein the first ends are coupled to the rotatable member. The system also may include at least one ballast. The second ends may be coupled to the ballast such that an angle is defined between the first and second struts. The sailboat also may include a drive system coupled to the canting ballast system wherein the at least one drive system is configured to rotate the canting ballast system with respect to the hull.

These and other features and advantages are evident from the following description of the present invention, with reference to the accompanying drawings.

DETAILED DESCRIPTION

Figure 1:
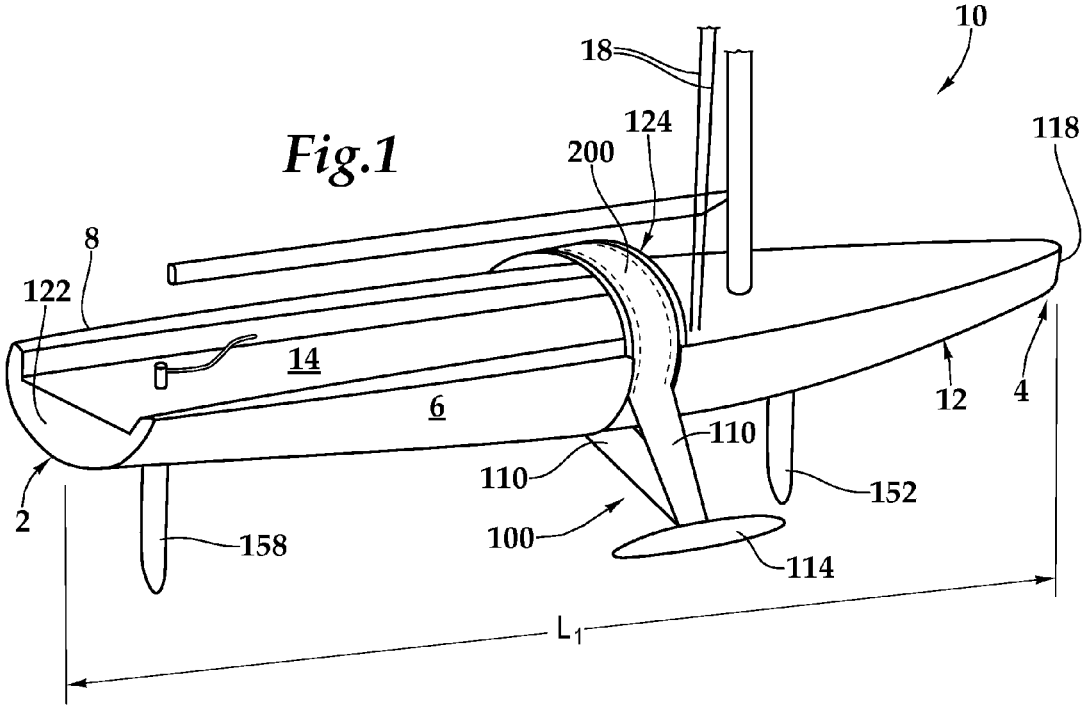
FIG. 1 is a perspective view of one embodiment of a sailing yacht having a canting ballast system.

Referring to FIG. 1, a high performance sailing yacht or sailboat 10 may include a hull 12, a deck 14, at least one mast, at least one boom, and standing rigging having at least one shroud 18 and/or running rigging (not shown) configured to maneuver the sail, mast, and/or boom. Yacht 10 has a stern or aft portion 2, a bow or forward portion 4, a starboard side 6, and an opposing port side 8.

Yacht 10 also includes a canting ballast system 100 coupled thereto that is configured to improve the performance, efficiency, and safety of yacht 10. In one embodiment, ballast system 100 is a substantially rigid system and is coupled to at least one external surface of yacht 10.

Canting ballast system 100 may include a plurality of struts 110 and a ballast 114 coupled thereto. Ballast 114 of system 100 may be canted in and/or out of the water, as will be described in more detail herein. In one embodiment, system 100 is coupled externally to hull 12 with at least one rotatable member or ring 200. Because system 100 is substantially coupled to at least one external surface of hull 12, hull 12 does not include an opening that would normally be necessary to couple a canting ballast system to hull 12. Moreover, system 100 may be fabricated from a composite material such as, glass, Kevlar, carbon or other fiber laid in polyester, vinylester, epoxy, other resin, wood, aluminum, steel, and/or any combination thereof, or any other appropriate hull building material.

Hull

Figure 2:
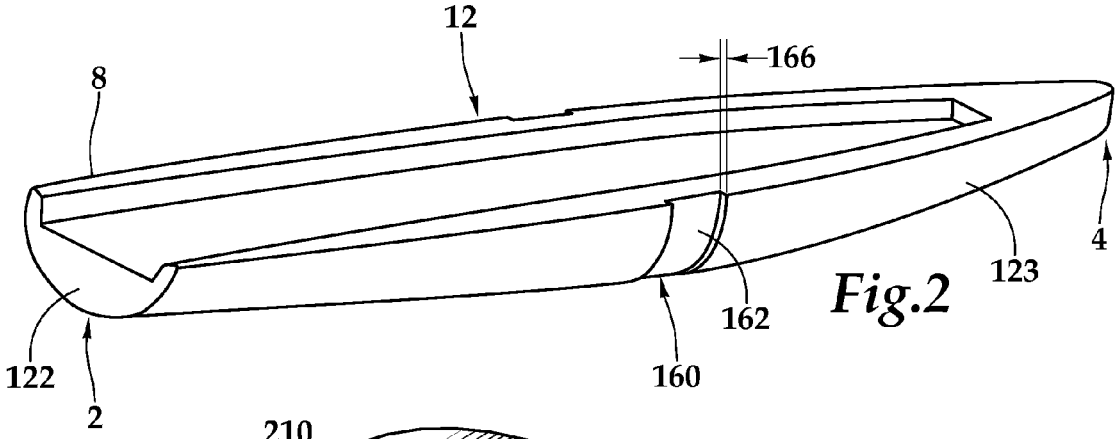
FIG. 2 is a perspective view of one embodiment of a hull of FIG. 1.
Figure 4:
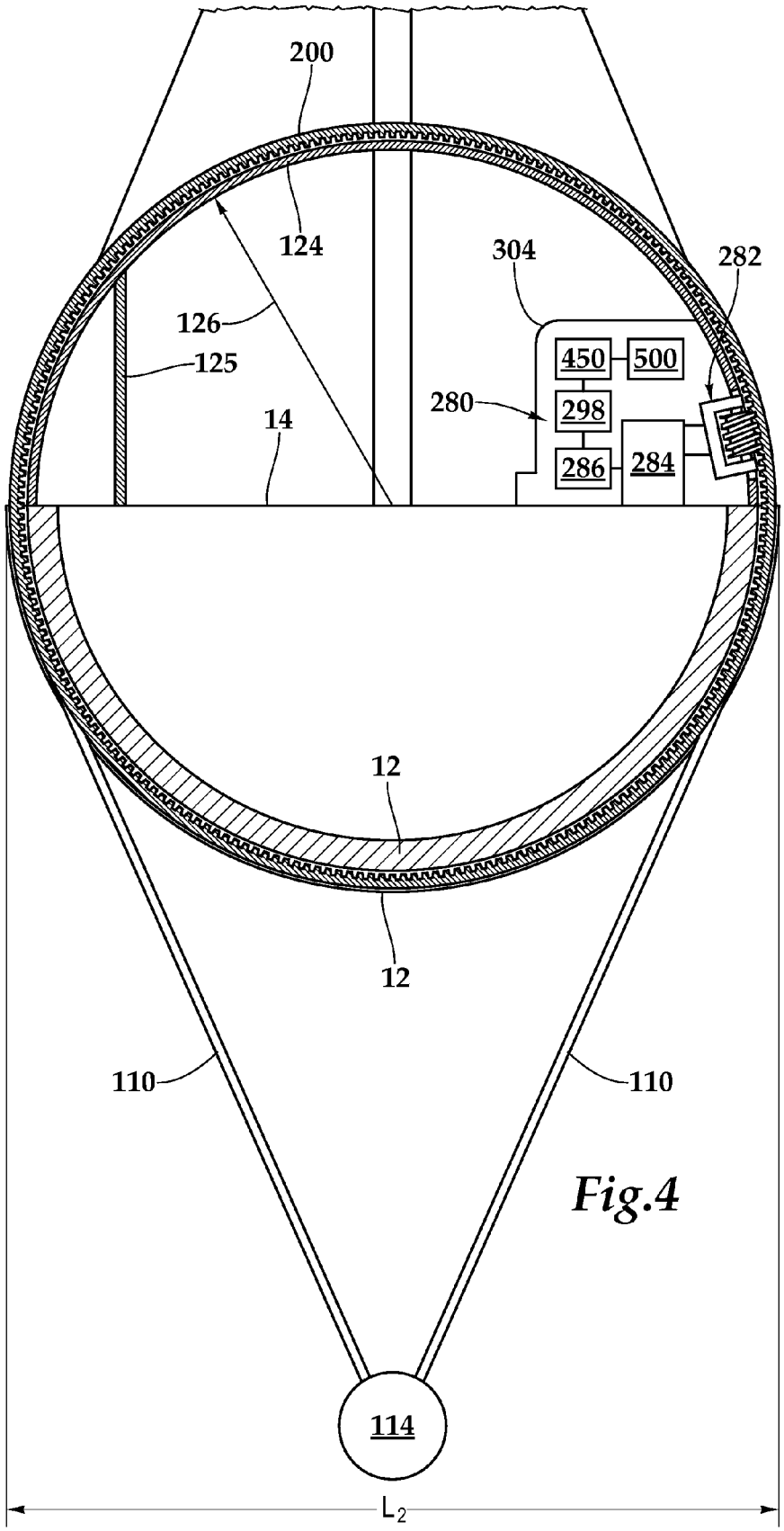
FIG. 4 is a cross-sectional view of the sailing yacht and canting ballast system of FIG. 1.

Referring to at least FIGS. 1, 2, and 4, hull 12 may have a length $L_1$ defined between a forward end 118 and an aft end 122 of yacht 10, and a length $L_2$ is defined between starboard side 6 and port side 8 at the widest part of yacht 10 (sometimes referred to as the beam). In one embodiment, system 100 is positioned at or proximate the beam. Alternatively, system 100 is coupled to yacht 10 not at the beam.

In one embodiment, $L_1$ is greater than L2. The beam to length ratio may be $L_2/L_1$. In one embodiment, the $L_2/L_1$ ratio is about 1/10 to about 1/2. Length $L_1$ may be between about 2' and about 500', and length $L_2$ may be between about 0.5' and about 50'. Moreover, hull 12 has an external surface 123.

For example, if yacht 10 were a racing yacht, length $L_1$ of yacht 10 may be about 50 feet and length $L_2$ may be about 14 feet, and mast height may be about 72 feet. In a second example, if yacht 10 were a racing yacht, length $L_1$ of yacht 10 may be about 98 feet and length $L_2$ may be about 18 feet, and the height of the mast may be about 144 feet.

Hull 12 may be any type of hull and should be fabricated with a shape that is configured to facilitate increasing the efficiency of canting ballast system 100. For example, hull 12 may be a smooth curve hull, a chined hull, a V-bottom chined hull, a flat-bottom chined hull, or a multi-chined hull. Preferably, in one embodiment, at least a portion of hull 12 has a substantially circular cross-section such that system 100 is coupled to the portion of the hull having the substantially circular cross-section. Further, in one embodiment, as system 100 may couple to yacht 10 at the beam, hull 12 may have a substantially circular cross-section at the beam.

Hull 12, forward and aft of system 100, may have any shape. For example, hull 12 may flare fore and aft of system 100, or hull 12 may have hard or soft chines aft of system 100 to create a wider planing shape and increase stability of yacht 10. Moreover, hull 12 may be fabricated from a composite material such as, glass, Kevlar, carbon or other fiber laid in polyester, vinylester, epoxy, other resin, wood, aluminum, steel, and/or any combination thereof, or any other appropriate hull building material.

Figure 5:
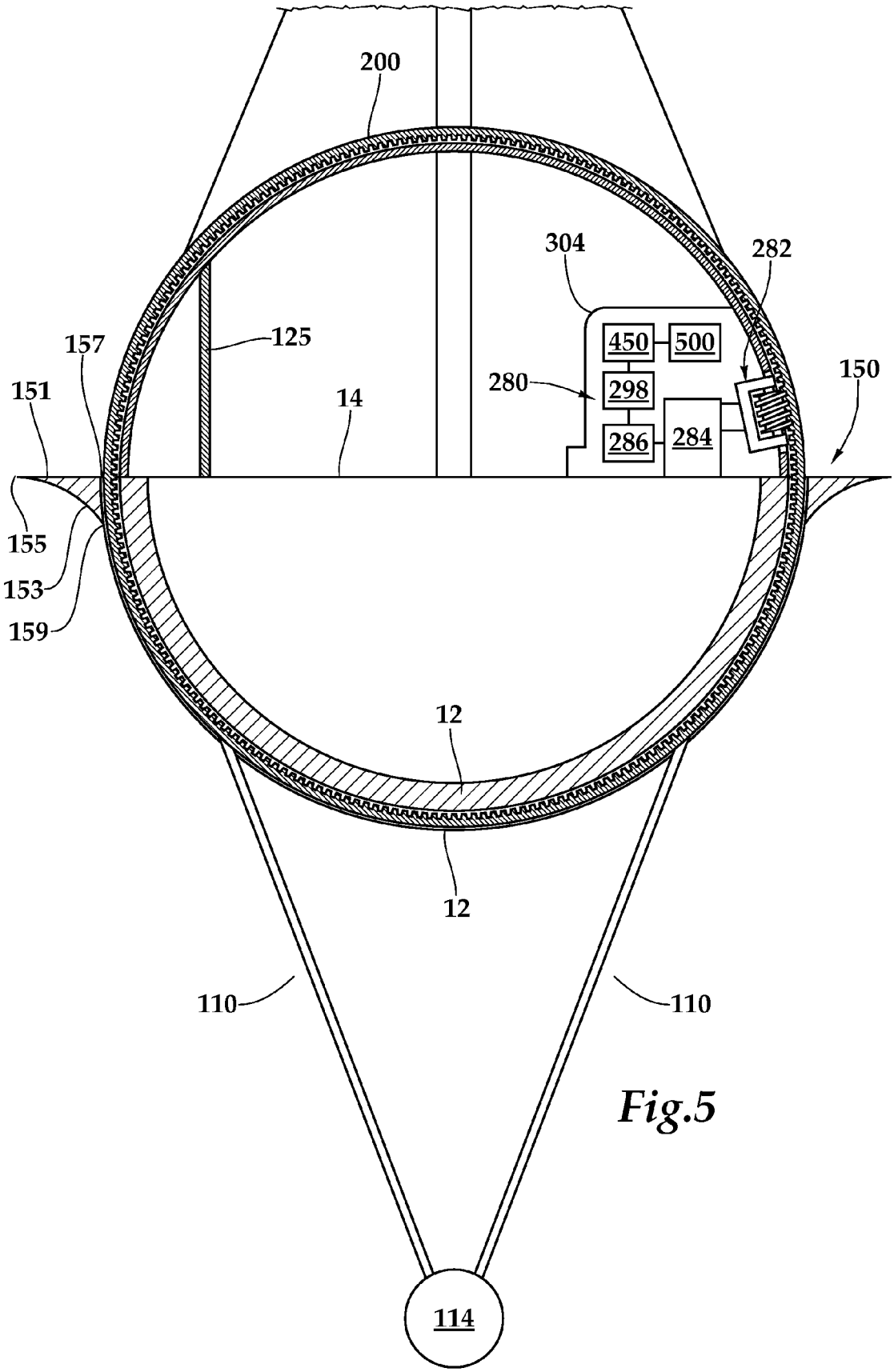
FIG. 5 is a cross-sectional view of a sailing yacht with a hull having at least one wing and the canting ballast system of FIG. 1.

In another embodiment and referring to FIG. 5, hull 12 may include at least one wing 150 extending therefrom to widen hull 12. For example, at least one wing 150 extends from hull 12 on starboard side 6 and at least one wing 150 extends from hull 12 on port side 8. Each wing 150 may have any shape. For example, as shown in FIG. 5, each wing 150 may include a substantially planar surface 151, extending outward from the top of hull 12, and a substantially curvilinear surface 153 wherein surfaces 151 and 153 intersect at a point 155. Wing 150 may include at least one opening 157 defined within surface 151 and at least one corresponding opening 159 defined within surface 153. Openings 157 and 159 are sized and positioned to enable ring 200 to extend therethrough.

Channel

Figure 6:
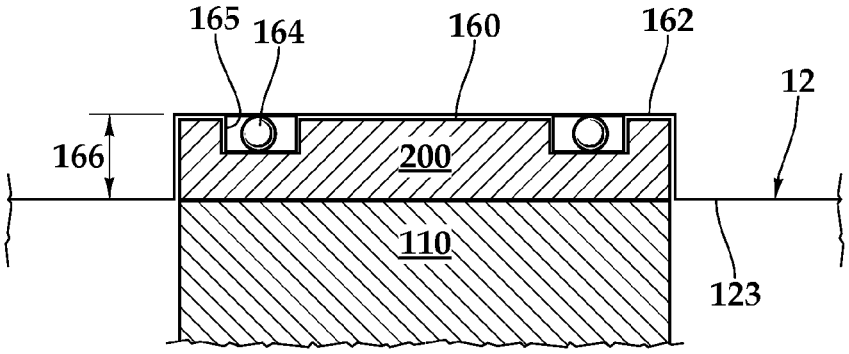
FIG. 6 is a cross-sectional view of a ring, strut, and hull of FIG. 1.
Figure 7:
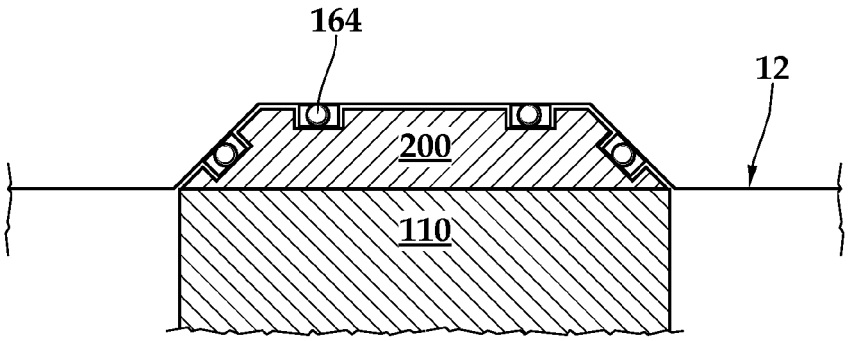
FIG. 7 is another cross-sectional view of a ring, strut, and hull of FIG. 1.

Returning to FIG. 2, a channel or an indentation 160 may be defined within hull 12 configured to receive at least a portion of ring 200 (shown in FIG. 3) and a plurality of bearings 164, discussed herein. In one embodiment, channel 160 is defined circumferentially within hull 12 and is preferably defined within external surface 123. Channel 160 has an inner bearing surface 162 and a depth 166. Depth 166 is defined between hull surface 123 and surface 162. As shown in FIG. 6, channel 160 may have a rectangular cross-sectional shape. Alternatively, channel 160 may have any cross-sectional shape. For example, as shown in FIG. 7, channel 160 has a trapezoidal shape.

Furthermore, hull 12 may include a plurality of channels 160 wherein each channel is configured to receive at least a portion of a ring 200 and/or at least one bearing 164.

In an alternative embodiment, hull 12 may not include channel 160.

Foils

Returning to FIG. 1, hull 12 may also include a plurality of foils coupled thereto configured to facilitate reducing leeway and increasing sailing performance by increasing velocity made good (VMG). In one embodiment, as shown in FIG. 1, a forward foil 152 is coupled to hull 12 forward of system 100 wherein forward foil 152 is positioned along a longitudinal centerline of yacht 10 and may rotate and/or jibe and/or retract.

Also shown in FIG. 1, in addition to forward foil 152, an aft foil 158 may be coupled to hull 12 aft of system 100 wherein aft foil 158 is positioned along the longitudinal centerline of yacht 10. Forward foil 152 and aft foil 158 may be configured to rotate in the same and/or opposite directions.

In an alternative embodiment, in addition to forward foil 152, a first aft foil (not shown) and a second aft foil (not shown) may be coupled to hull 12 aft of system 100. Particularly, first aft foil may be coupled to hull 12 on starboard side 6 aft of system 100 and second aft foil may be coupled to hull 12 on port side 8 aft of system 100.

In a further alternative embodiment, a first forward foil (not shown) is coupled to hull 12 on starboard side 6 forward of system 100 and a second forward foil (not shown) is coupled to hull 12 on port side 8 forward of system 100. Each of the first and second forward foils may be angled outwards and may retract in and/or out of hull 12. Further, in this further alternative embodiment, first and second forward foils are generally not configured to rotate.

In an additional alternative embodiment, in addition to first forward foil (not shown) and second forward foil (not shown), a first aft foil (not shown) and a second aft foil (not shown) may be coupled to hull 12 aft of system 100. Particularly, first aft foil may be coupled to hull 12 on starboard side 6 aft of system 100 and second aft foil may be coupled to hull 12 on port side 8 aft of system 100. The first and second forward foils may not rotate, and first and second aft foils may be configured to rotate.

Arcuate Member

Figure 1A:
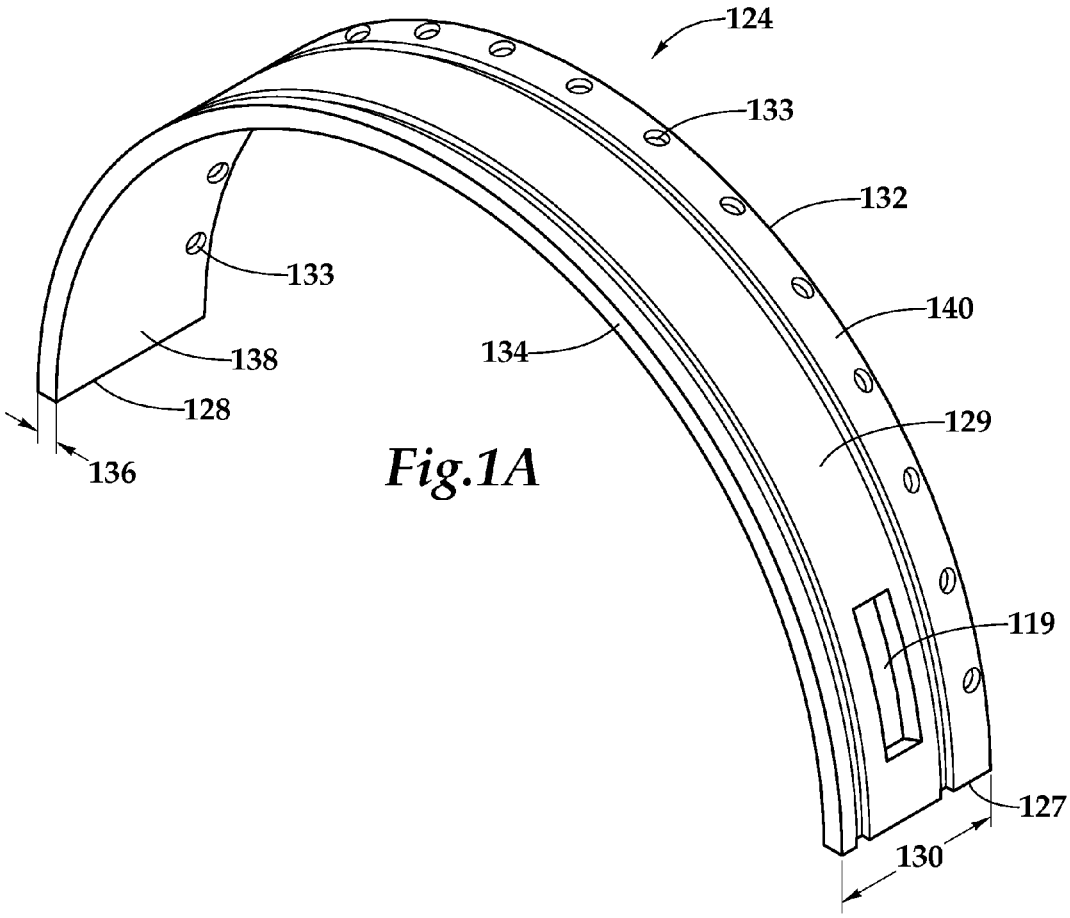
FIG. 1A is a perspective view of one embodiment of an arcuate member of FIG. 1.

Turning to at least FIGS. 1 and 1A, an arcuate member 124 may be coupled to hull 12 to facilitate enabling system 100 to rotate around hull 12. In one embodiment, member 124 is coupled to yacht 10 at the beam. In an alternative embodiment, member 124 is coupled at any location along yacht 10. Alternatively, arcuate member 124 is formed along with the cabintop, which may be part of deck 14.

In one embodiment, member 124 extends between a first end 127, configured to couple to starboard side 6, and a second end 128, configured to couple to port side 8. Returning to FIG. 1A, member 124 has a width 130 defined between a forward edge 132 and an aft edge 134, and a thickness 136 is defined between a radially inner surface 138 and a radially outer surface 140. In one embodiment, arcuate member 124 includes at least one channel 129 defined therein to receive at least a portion of ring 200. In an alternative embodiment, arcuate member 124 does not include channel 129.

Member 124 may also include at least one slot or opening 119 defined therein. Preferably, slot 119 would be defined between forward edge 132 and aft edge 134. Slot 119 may be sized to enable a portion of a gear, cable, or roller to extend through slot 119 to engage a surface of ring 200.

Additionally, member 124 may also include a plurality of openings 133 defined therein. Openings 133 may be positioned circumferentially around member 124. Openings 133 may be configured to receive at least a portion of a pin stop and/or frictional brake.

Now referring to FIG. 4, member 124, together with hull 12, may form a generally circular cross-section, when viewed from stern 2 or bow 4 to facilitate coupling system 100 to yacht 10 such that member 124 may have a radius 126. In one embodiment, radius 126 is sized such that an individual on deck 14 of yacht 10 could maneuver over, around, and/or under member 124. Further, in one embodiment, radius 126 is between about ¼*(length $L_2$) and about 1*(length $L_2$), preferably radius 126 is about ½*(length $L_2$). Alternatively, member 124 has any shape that facilitates operation of system 100.

Moreover, one or more support members 125 may be coupled between deck 14 and member 124 to facilitate supporting and increasing the durability of member 124.

Figure 5B:
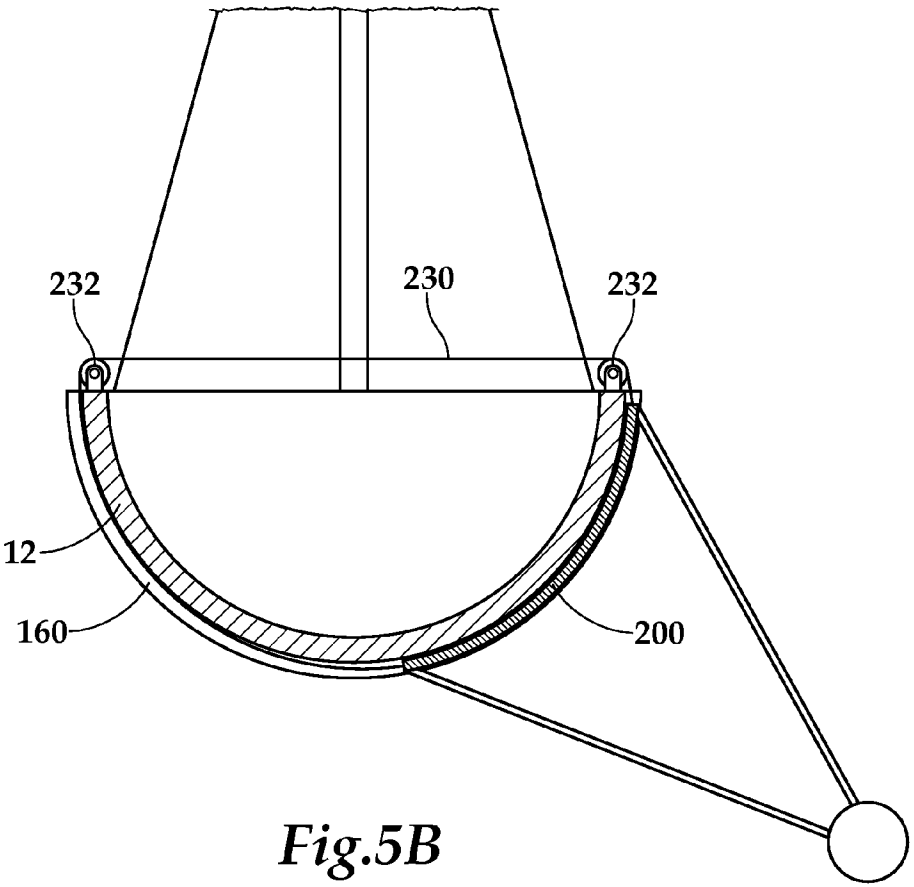
FIG. 5B is a cross-sectional view of the alternative canting ballast system of FIG. 5A in a second position.
Figure 5A:
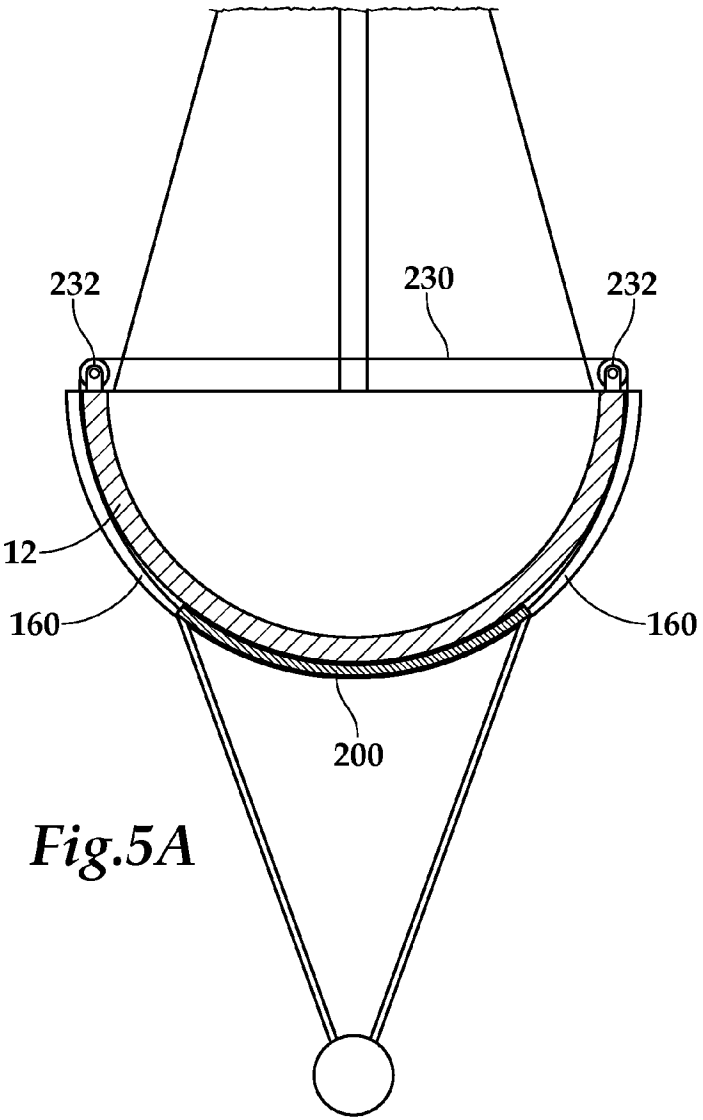
FIG. 5A is a cross-sectional view of an alternative canting ballast system in a first position.

Turning to FIGS. 5A and 5B, in another embodiment, yacht 10 may not include member 124 when at least a section of ring 200 is fabricated from a substantially flexible material, discussed in more detail herein.

Ring

Returning to FIGS. 1 and 3, system 100 may include rotatable member or ring 200 that is configured to couple to and/or circumscribe at least a portion of hull 12 and/or a portion of member 124. Ring 200 may couple within and/or proximate channel 160 of hull 12. Alternatively, ring 200 may couple entirely to external surface 123 of hull 12 and/or arcuate member 124 such ring 200 is not coupled within a channel 160. In one embodiment, ring 200 is coupled to yacht 10 at the beam. Alternatively, ring 200 is coupled at any position along the length of yacht 10.

As shown in FIG. 5, in one embodiment, when hull 12 has at least one wing 150, ring 200 still couples to hull 12 and/or a portion of member 124; however, ring 200 extends through openings 157 and 159 in wing 150.

Returning to FIGS. 1 and 3, ring 200 has a substantially circular cross-section, a width 204 defined between an aft edge 206 and a forward edge 208, that may be less than width of member 124 and may be less than width of channel 160, and a thickness 210 that is defined between a radially inner surface or outer bearing surface 212 and a radially outer surface 214.

Figure 3:
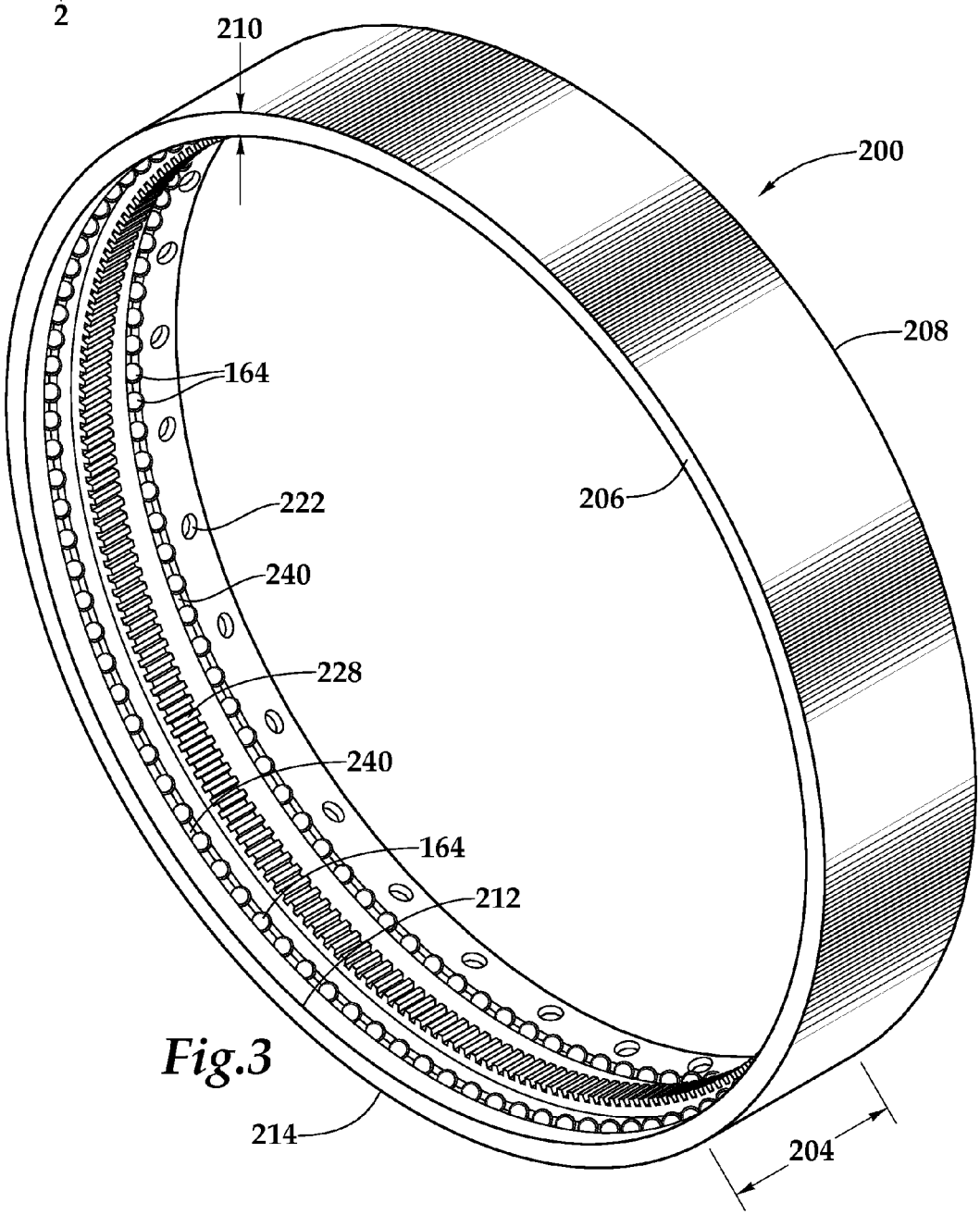
FIG. 3 is a perspective view of one embodiment of a ring without struts of FIG. 1.

Ring 200 may be fabricated from a composite material such as, glass, Kevlar, carbon or other fiber laid in polyester, vinylester, epoxy, other resin, wood, aluminum, steel, and/or any combination thereof, or any other appropriate ring building material. In one embodiment, as shown in FIG. 3, ring 200 is a unitary member and is fabricated from a substantially rigid material. Alternatively, ring 200 may not be a unitary member but rather may be fabricated from a plurality of segments wherein the segments are coupled together to form ring 200.

Alternatively, as shown in FIGS. 5A and 5B, a portion of ring or rotatable member 200 may be fabricated from a substantially rigid material and another portion of ring or rotatable member 200 may be fabricated from a substantially flexible material wherein the substantially flexible material is water resistant. For example, a portion of ring or rotatable member 200 that is coupled to hull 12 may be fabricated of substantially rigid material and another portion of ring 200 may be fabricated of cabling/rigging or other substantially flexible material 230 to run along a portion of deck 14. Specifically, in this embodiment, rather than an arcuate member 124, at least one pulley 232 is coupled to hull 12 proximate deck 14 to facilitate rotation of ring 200. Moreover, in this embodiment, ring or rotatable member 200 may include a plurality of substantially rigid material segments coupled to a plurality of substantially flexible material segments.

Returning to FIG. 3, ring 200 may also have at least one channel 240 defined therein configured to receive and/or mate with bearings 164 and/or a casing. Channel 240 may be defined along radially inner surface 212. In one embodiment, ring 200 has at least two channels 240 defined therein such that each channel 240 is configured to receive bearings 164 and/or a casing.

Ring 200 may also have a plurality of teeth 228 defined within surface 212 configured to engage at least one gear, discussed herein, to facilitate rotating ring 200 at least partially around hull 12. Teeth 228 may have a plurality of sizes and may be of varying depth to accommodate different gear sizes. As shown in FIG. 3, teeth 228 may be positioned between two channels 240.

Ring 200 may also include at least one or a plurality of recesses or openings 222 defined at least partially within surface 212 configured to engage at least one pin stop to facilitate locking ring 200 in a predetermined position. In one embodiment, recesses 222 are defined circumferentially within ring 200 and are configured to align with openings 133 in arcuate member 124. A predetermined distance may be defined between each recess 222. For example, each recess 222 may be positioned approximately every 5 degrees.

Figure 8:
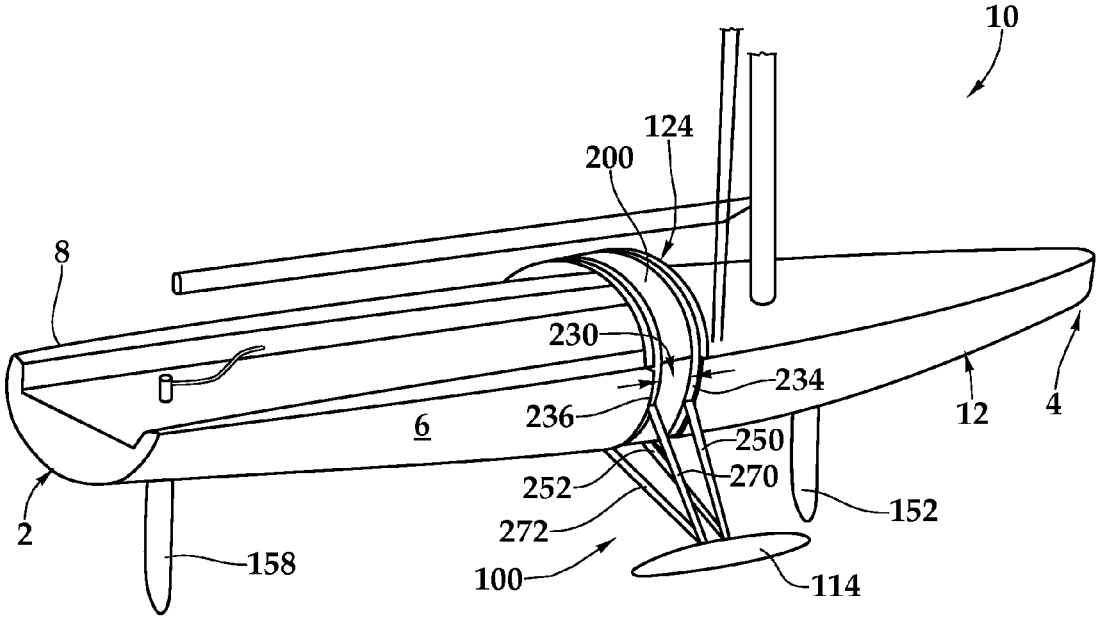
FIG. 8 is a perspective view of a sailing yacht with another alternative embodiment of a canting ballast system.
Figure 9:
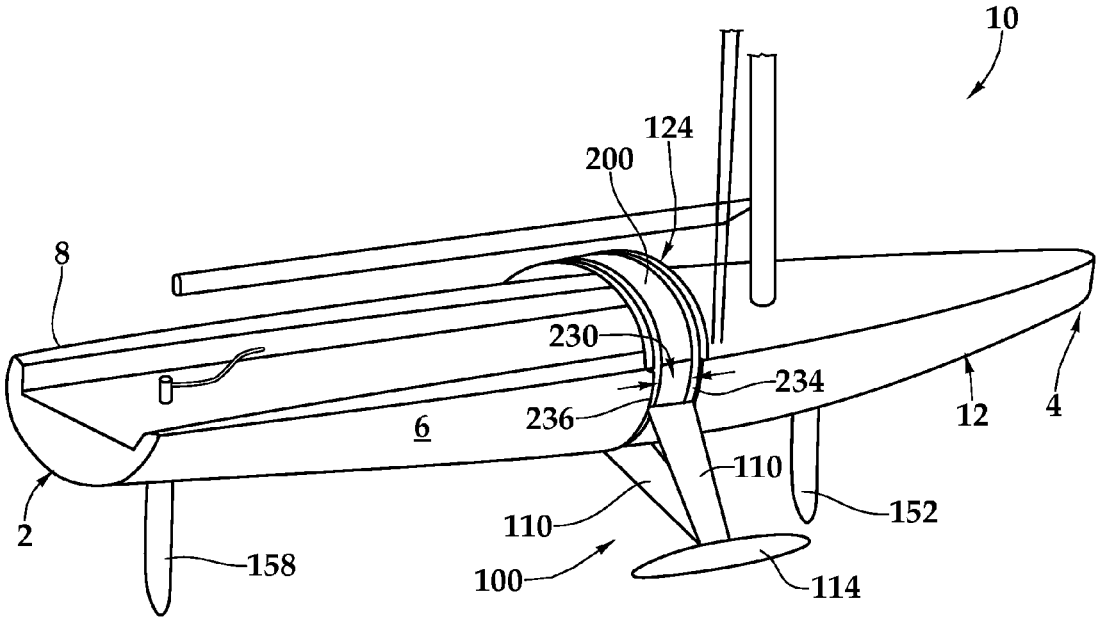
FIG. 9 is a perspective view of a sailing yacht with a further alternative embodiment of a canting ballast system.

Now referring to FIGS. 8 and 9, system 100 may include a plurality of rings. In FIG. 8, system 100 includes a first ring 234 and a second ring 236 and four struts coupled thereto. In FIG. 9, system 100 includes first ring 234 and second ring 236 and two struts coupled thereto. Each ring 234 and 236 may be configured with a cross-sectional shape suitable to couple to hull 12. In one embodiment, each ring 234 and 236 has a substantially circular cross-sectional shape and each ring 234 and 236 has substantially the same diameter. Alternatively, each ring 234 and 236 has a substantially circular cross-sectional shape but each ring 234 and 236 has a different diameter. Rings 234 and 236 may be mechanically coupled together.

Figure 10:
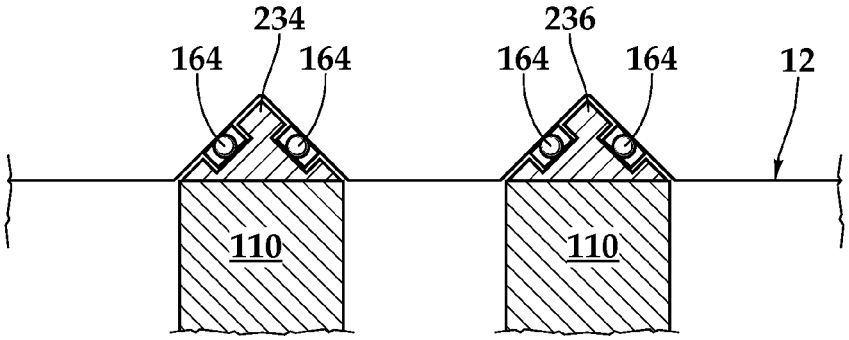
FIG. 10 is a cross-sectional view of the rings, struts, and hull of FIG. 8.
Figure 11:
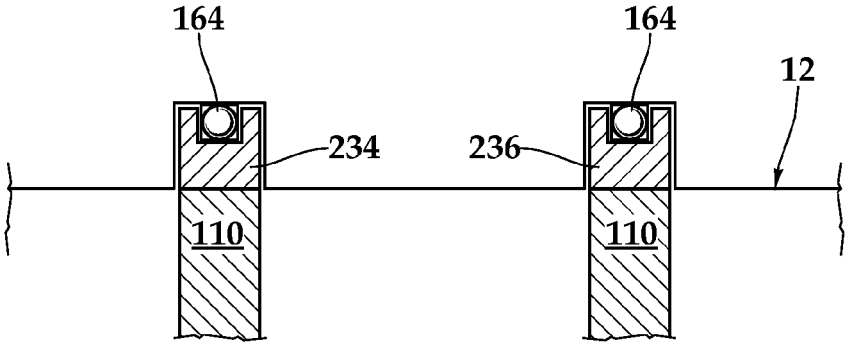
FIG. 11 is a further cross-sectional view of the rings, struts, and hull of FIG. 8.

When system 100 includes more than one ring 200, hull 12 and/or arcuate member 124 may include more than one channel 160 wherein each channel 160 may be configured to receive bearings 164 and/or at least one ring therein. For example, referring to FIGS. 10 and 11, hull 12 includes two channels 160 wherein one channel 160 is configured to receive ring 234 and one channel 160 is configured to receive ring 236. Referring to FIG. 10, channels 160 have a rectangular cross-sectional shape. Referring to FIG. 11, channels 160 have a triangular cross-sectional shape. Alternatively, channels 160 may have any cross-sectional shape.

Bearings

Referring to at least FIGS. 3, 6-7, 10, and 11, system 100 may include a plurality of bearings 164 configured to be couple between hull 12 and ring 200. Preferably, bearings 164 are coupled circumferentially around hull 12 and/or arcuate member 124 between inner bearing surface 162 of hull 12 and at least outer bearing surface 212 of ring 200. Bearings 164 facilitate rotation of ring 200 with respect to hull 12 and/or arcuate member 124.

In one embodiment, bearings 164 may be coupled within a cage or housing 165 such that bearings 164 are spaced a distance apart.

Bearings 164 may be a combination of bearings. For example, bearings 164 may be at least one of or a combination of, but is not limited to, simple bearings, ball bearings, needle bearings, roller bearings, and rollers configured to reduce friction and allow for ring 200 to rotate around hull 12.

Bearings 164 may be fabricated of nylon, Torlon, or other appropriate plastic, composite, metal, a combination thereof, and/or other material to act as the bearing "rollers".

Pin Stop and Frictional Brake

Referring to FIGS. 12 A-D, system 100 also may include at least one stop 216 and/or at least one frictional brake 219 configured to regulate the rotation of ring 200 around hull 12. Stop 216 and/or frictional brake 219 may be coupled to member 124, ring 200, and/or hull 12. Specifically, stop 216 and/or frictional brake 219 may be at least one of a pin-stop, a spring-loaded pin-stop, a friction brake, and/or another mechanism to facilitate regulating rotation (i.e., braking) of ring 200, and/or any combination thereof.

Figure 12A:
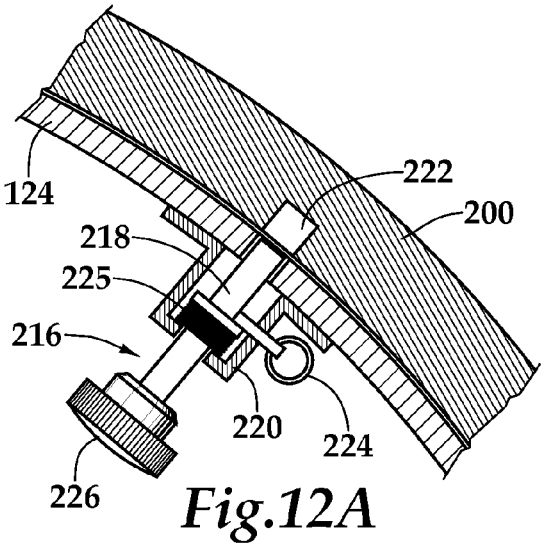
FIG. 12A is a cross-sectional view of a pin stop in a first position.

Referring to FIGS. 12A and B, in one embodiment, pin-stop 216 is configured to selectively lock ring 200 in a predetermined position. The pin-stop may include at least one pin or plunger 218 and housing 220. Housing 220 may be coupled to deck 14, arcuate member 124, and/or hull 12. In one embodiment, a pin stop 216 or a plurality of pin stops 216 are coupled to surface 138 of arcuate member 124.

Figure 12B:
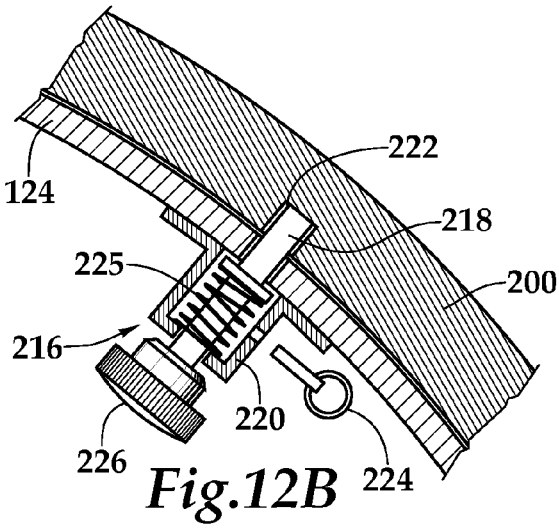
FIG. 12B is a cross-sectional view of the pin stop of FIG. 12A in a second engaged position.

Pin 218 may be spring loaded such that spring 225 is held in compression by a fast-pin 224. As shown in FIG. 12B, by pulling fast-pin 224 out of pin-stop, spring 225 pushes pin 218 towards ring 200 and into at least one of recess 222 and opening 133. To disengage pin-stop from ring 200, pin 218 can be pulled back towards housing 220 by a handle 226 that is coupled to pin 218. As shown in FIG. 12A, when spring 225 is in compression and is fully retracted, fast-pin 224 can be re-inserted into pin-stop 216. Ring 200 and/or member 124 may have indicia or markings to indicate when pin 218 and recess 222 are aligned to facilitate increasing the ease of locking ring 200 to member 124. While the pin-stop is engaged and ring 200 is locked in a predetermined position, a drive system, discussed herein, may be removable for repair or replacement with the ballast locked in place.

Figure 12C:
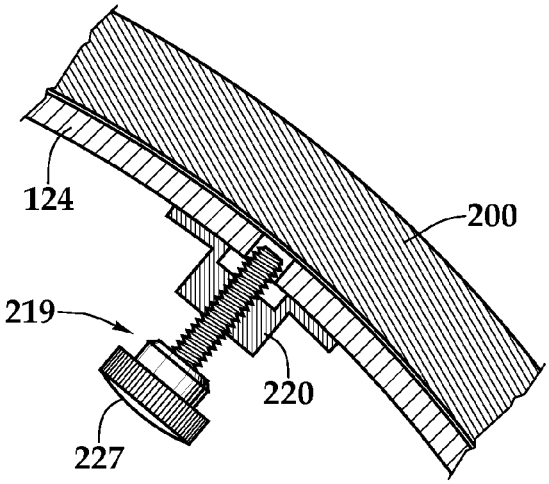
FIG. 12C is a cross-sectional view of a frictional brake in a first position.
Figure 12D:
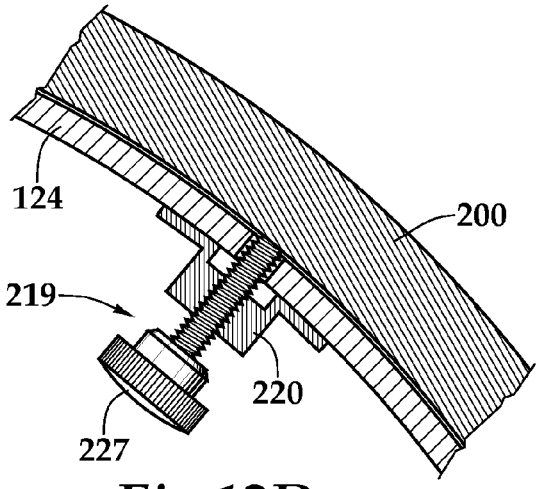
FIG. 12D is a cross-sectional view of the frictional brake of FIG. 12C in a second engaged position.

Turning to FIGS. 12C and 12D, system 100 may also include a frictional brakes or a plurality of frictional brakes 219. The frictional brake 219 may be coupled within a housing 220 wherein housing 220 may be coupled to arcuate member 124. The frictional brake 219 is configured to slow ring 200 when ring 200 is rotating. To slow ring 200, the frictional brake 219 may be turned by a handle 227 from a first position shown in FIG. 12C to a second position shown in FIG. 12D. As shown in FIG. 12D, the frictional brake 219 may extend at least partially through an opening (not shown) defined within arcuate member 124 and/or hull 12.

Ballast Struts

Referring to at least FIGS. 1, 13-15, and 15A, system 100 further includes at least two struts 110 and ballast 114 coupled thereto.

Each strut 110 may be coupled to ring 200 in a variety of ways. In one embodiment, ring 200 and struts 110 are fabricated together as one structure. In another embodiment, each strut 110 is coupled to ring 200. For example, each strut 110 may be welded to ring 200. Alternatively, each strut 110 may be coupled to ring 200 with fastening mechanisms such as, but not limited to, screws or bolts or pins.

Figure 14:
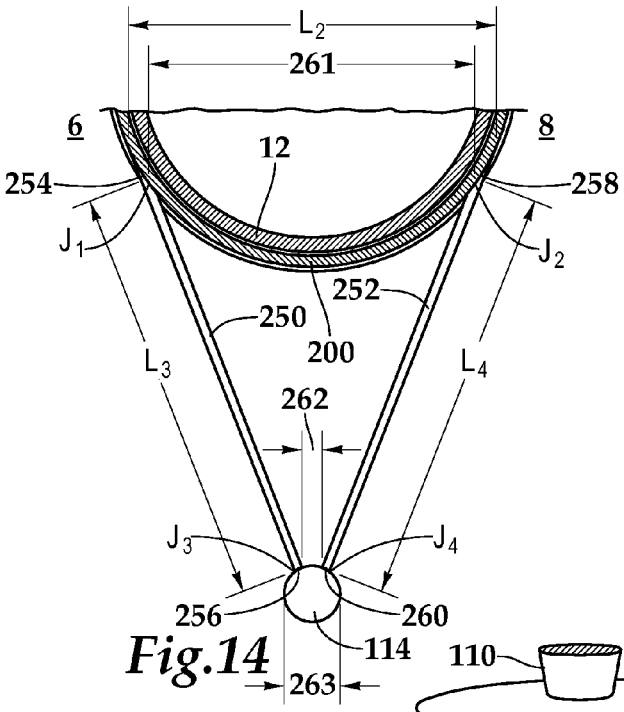
FIG. 14 is a cross-sectional view of canting ballast system one of the canting ballast systems of FIGS. 1, 8, and 9.
Figure 13:
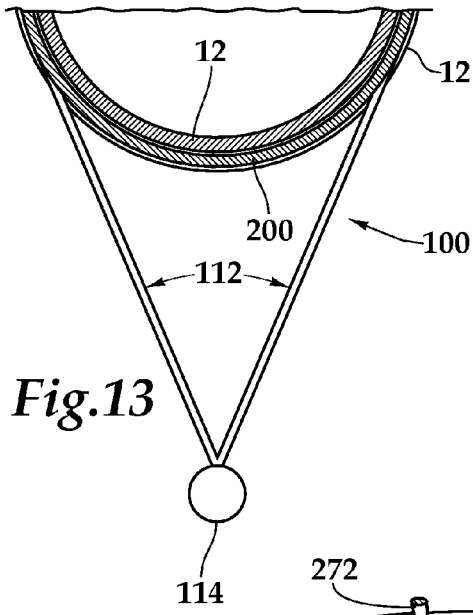
FIG. 13 is a cross-sectional view of one of the canting ballast systems of FIGS. 1, 8, and 9.

Referring to FIGS. 13 and 14, two struts 250 and 252 are coupled to ring 200. Turning to the details of each strut, first strut 250 has a length $L_3$ defined between a first end 254 configured to couple to ring 200 and an opposing second end 256 configured to couple to ballast 114. Similarly, second strut 252 has a length $L_4$ defined between a first end 258 configured to couple to ring 200 and an opposing second end 260 configured to couple to ballast 114.

In one embodiment, struts 250 and 252 have substantially the same length such that lengths $L_3$ and $L_4$ are substantially the same. In an alternative embodiment, struts 250 and 252 have different lengths $L_3$ and $L_4$, respectively. For example, struts 250 and 252 may have different lengths $L_3$ and $L_4$ if yacht 10 is designed for a specific racing course or if yacht 10 is built asymmetrically.

Length $L_3$ is between about $\frac{1}{10}$*(length $L_1$) and about $\frac{1}{2}$*(length $L_1$), and is preferably between about $\frac{1}{3}$*(length $L_1$) and about $\frac{1}{6}$*(length $L_1$). Length $L_4$ is between about $\frac{1}{10}$*(length $L_1$) and about $\frac{1}{2}$*(length $L_1$), and preferably between about $\frac{1}{3}$*(length $L_1$) and about $\frac{1}{6}$*(length $L_1$). Further, length $L_3$ may be between about $\frac{1}{2}$*(length $L_2$) and about 2*(length $L_2$), and length $L_4$ may be between about $\frac{1}{2}$*(length $L_2$) and about 2*(length $L_2$).

Further referring to FIG. 14, in one embodiment, first end 254 is configured to couple ring 200, preferably on starboard side 6, defining a junction $J_1$, and first end 258 is configured to couple to ring 200, preferably on port side 8, defining a junction $J_2$, and second ends 256 and 260 are configured to couple to ballast 114. In one embodiment, second end 256 is configured to couple to ballast 114 defining a junction $J_3$ and second end 260 is configured to couple to ballast 114 defining a junction $J_4$. For example, second end 256 is coupled to the side of ballast 114 and second end 260 is coupled to the opposite side of ballast 114.

A distance 261 is defined between junction $J_1$ and junction $J_2$, and a distance 262 is defined between junction $J_3$ and $J_4$. In one embodiment, distance 261 is larger than distance 262. For example, distance 261 may be between about 1*(radius 202 of ring 200) and about 2*(radius 202 of ring 200) and distance 262 may be less than about 2*(radius 202 of ring 200). Further, distance 262 may be greater than a lateral width 263 of ballast 114.

Further referring to FIG. 13, rather than second ends 256 and 260 coupling to ballast 114 at respective junctions $J_3$ and $J_4$, struts 250 and 252 intersect proximate ends 256 and 260. When struts 250 and 252 intersect, struts 250 and 252 form a V-shape having an angle 112 defined therebetween. In one embodiment, angle 112 is at least partially determined by the length of each strut 250 and 252. Angle 112 is between about 1 degrees and about 180 degrees, preferably between about 15 degrees and about 80 degrees, and more preferably between about 20 degrees and about 45 degrees.

Figure 15:
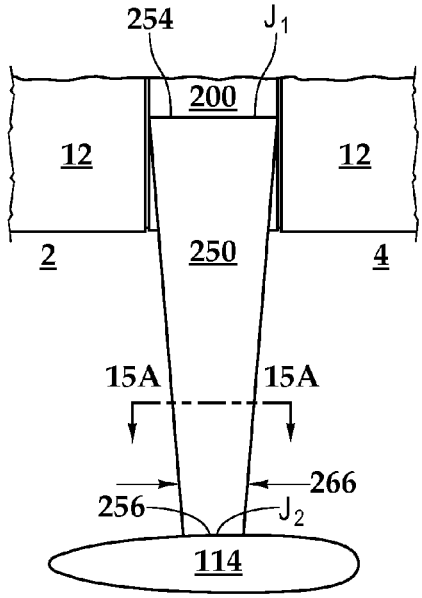
FIG. 15 is a side view of canting ballast system of FIG. 1.
Figure 15A:
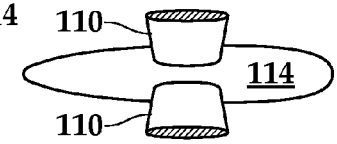
FIG. 15A is a cross-sectional view of struts of FIG. 15.

Struts 250 and 252 may have any cross-sectional shape that facilitates operation of system 100. Referring to FIGS. 15 and 15A, each strut 250, 252 may have a substantially elliptical cross-sectional shape with one or more ogive to facilitate streamlining each strut while reducing potential drag when yacht 10 is sailing. In a further embodiment, each strut 250, 252 may have any shape cross-section that facilitates a good balance between strength and low hydrodynamic drag.

Further referring to FIG. 15, strut 250 has a width 266 and strut 252 has a width (not shown). In one embodiment, width 266 may vary between first end 254 and second end 256, and the width of strut 252 (not shown) may vary between first end 258 and second end 260. For example, as shown in FIG. 15, width 266 may taper between first end 254 and second end 256 such that width 266 is larger at first end 254 than at second end 256, and width of strut 252 may taper between first end 258 and second end 260.

Struts 250 and 252 may be fabricated unitarily. Alternatively, each strut 250 and 252 may be fabricated of a plurality of sections coupled together with at least one fastening mechanism to form a single strut.

Each strut 250 and 252 is configured to have column strength to withstand compression and elongation to prevent undue fatigue to struts 250 and 252.

Figure 17:
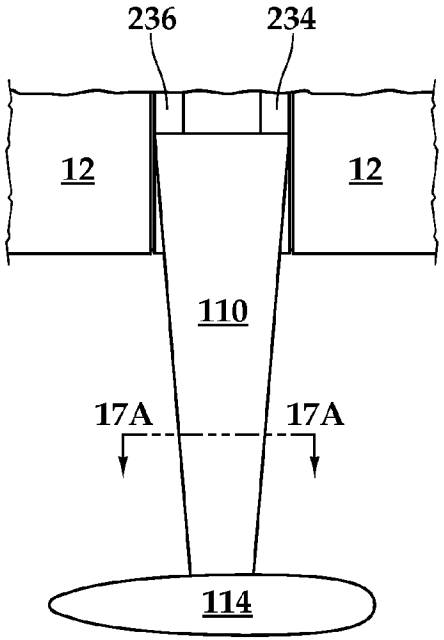
FIG. 17 is a side view of canting ballast system of FIG. 9.
Figure 17A:
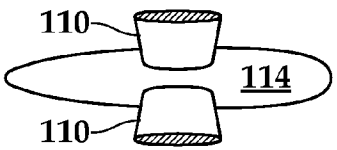
FIG. 17A is a cross-sectional view of struts of FIG. 18.

In comparison to FIGS. 15 and 15A showing struts 250 and 252 coupled to one ring 200, FIGS. 9 and 17 show an embodiment where each strut 250 and 252 may couple to both rings 234 and 236. Moreover, as shown in FIGS. 17 and 17A, each strut 250 and 252 may couple to ballast 114.

Figure 16:
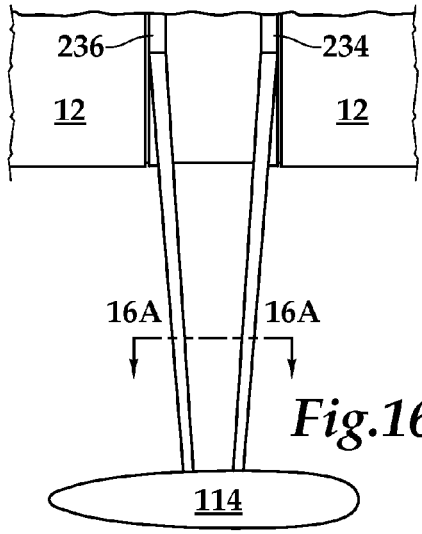
FIG. 16 is a side view of canting ballast system of FIG. 8.
Figure 16A:
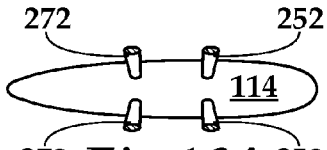
FIG. 16A is a cross-sectional view of struts of FIG. 16.

Referring to FIGS. 8, 16 and 16A, when system 100 includes more than one ring 200, ring 234 may include at least two struts 110 coupled thereto and ring 236 may include at least two struts 110 coupled thereto. As shown in FIG. 8, first ring 234 may include first strut 250 and second strut 252 coupled thereto, and second ring 236 may include a third strut 270 and a fourth strut 272 coupled thereto. In one embodiment, third and fourth struts 270 and 272 are similar to struts 250 and 252, respectively.

Ballast

Ballast 114 should be designed to have a sufficient weight to counteract moments and forces generated by yacht 10 to prevent yacht 10 from over rotating.

Further, ballast 114 may have any shape to obtain desired levels of pitching moment, surface drag, and wave drag. It is important to try to keep the center of gravity of yacht 10 as low as possible during sailing. For example, ballast 114 may have a substantially elliptical cross-sectional shape with one or more ogive to facilitate reducing potential drag when yacht 10 is sailing.

In an alternative embodiment, ballast 114 may be fabricated from a plurality of weights coupled together.

Canting Ballast Drive System

Referring to at least FIGS. 4, 5, 5A and 5B, yacht 10 may further include a canting drive system 280 configured to couple to and at least partially rotate system 100. Referring to FIG. 14, canting drive system 280 may include one or more of a gear system 282, a drive system 284, a position indication system 298, and/or at least one power source.

As shown in FIGS. 4 and 5, drive system 284 is configured to couple to gear system 282. However, as shown in FIGS. 5A and 5B, drive system 284 may be coupled to hull 12 and is preferably not coupled to a gear system 282. Rather, as shown in FIGS. 5A and 5B, drive system 284 may be coupled to pulleys 232 and/or substantially flexible material 230.

Drive system 284 may include more than one drive system. For example, a first drive system (not shown) may coupled on port side 8, and a second drive system (not shown) may coupled on starboard side 6.

Drive system 284 may include a motor (not shown), such as an electrical motor, configured to drive at least one gear of gear system 282, which is configured to drive system 100 and rotate ring 200 in a first direction and/or a second and opposite direction around hull 12. Drive system 284 may also include a control panel (not shown) configured to drive the motor.

Gear system 282 may be coupled to ring 200 and/or hull 12 and may include a plurality of gears wherein the gears may be any gear or friction roller or other coupling that facilitates operation of gear system 282. For example, gear system 282 may include a gear-wheel and/or a worm gear, shown in at least FIGS. 4 and 5.

The worm gear may act as a mechanical drive member. The worm gear may include teeth and/or ridges configured to engage teeth 228 on surface 212 of ring 200 to mechanically rotate ring 200 and/or cant system 100 to port side 8 and/or starboard side 6. In one embodiment, the worm gear or other gears are configured to extend through slot 119 within arcuate member 124 to enable the teeth of the gears to engage teeth 228 of ring 200.

In another embodiment, drive system 284 includes at least one winch and a cable coupled thereto to facilitate manual operation of system 100.

Yacht 10 may also include any suitable gear system 282 and/or drive system 284 that facilitates operation of system 100. For example, gear system 282 and/or drive system 284 may include gears, worm-gears, cables/pulleys, belts, chains, a mechanical drive transfer system, and/or any combination thereof.

System 280 may also include position indication system 298 configured to monitor and/or limit the rotation of system 100 to a desired canting angle for port side 8 and a canting angle for starboard side 6. In one embodiment, system 298 is configured to limit the canting angle for port side 8 to about 90 degrees and to limit the canting angle for starboard side 6 to about 90 degrees. Frictional brakes 219 and/or stops 216 may add further protection to limit the canting of system 100 in either direction 294 and/or 296 and/or slow the rotation of ring 200.

System 280 may include at least one power source and/or power system that electrically, hydraulically, pneumatically, and/or manually drives system 100. In one embodiment, the power source is one of the main and/or auxiliary engines (not shown) of yacht 10. In another embodiment, the power source is human power and/or another source of mechanical power. In a further embodiment, drive system 280 may be primarily driven electrically with drive system 280 and secondarily driven by human power via cables and/or pulleys connected to one or more grinder pedestals.

Canting drive system 280 may be mounted inside yacht 10 or within an enclosure 304 for protection, particularly from water. In another embodiment, canting drive system 280 may include other mechanisms—such as other mechanical gears and/or cable systems and/or pulley systems, to facilitate operation of system 100 and particularly in canting ballast 114.

Control System

System 100 may further include a control system 450, coupled to canting drive system 280, configured to control and optimize the rotation of system 100 for optimal performance both in straight line sailing and through tracking and gibing maneuvers. Control system 450 may be entirely manually, automatically, or semi-automatically controlled and operated. For example, if system 450 were entirely automatically controlled or semi-automatically controlled, a computer and/or computer system (not shown) may be coupled to system 450 to assist in the operation of system 100 to maximize performance, comfort, and other criteria chosen by the operator. Moreover, system 450 may have an input for controlling canting angle based on a number of sailing parameters such as heel angle, rudder angle, ballast position, wind strength, wind direction, bearing, sail selection, sheeting angles for sails, boat speed and/or other predetermined parameters.

Safety System

System 100 may also include a safety system 500 to prevent over rotating system 100 and/or rotating system 100 in a direction opposite the intended direction. Safety system 500 may include a computer control system (not shown) and/or a mechanical control (not shown). Computer and/or mechanical control systems may include inputs from at least one of a shroud tension, actual canting angle, boat heel angle, wind strength, boat speed, sea state, sail selection and sheeting angles, and/or other data.

Operation

During operation, system 100 is canted between starboard side 6 and port side 8 and ballast 114 of system 100 may be canted in the water or out of the water. Specifically, system 100 can rotate, similar to a pendulum, as required to keep yacht 10 at a desired heel angle. Particularly, system 100 exerts righting moment to counter heeling moment generated from the rig and sails of yacht 10 in order to maintain a desired angle of heel for maximum performance and/or comfortable sailing. As described herein, system 100 and struts 110 are designed to experience compression and tension loads, with the possibility of a small bending moment, rather than a large bending moment as in a traditional single strut canting ballast system. Reducing the size of the bending moment on struts 110 increases the durability and longevity of struts 110.

To start rotation and/or cant system 100, power source of canting drive system 280 supplies power to the motor of drive system 284. Motor 286, attached to gear system a gear spindle (not shown) and/or a cable, turns gear system 282. Particularly, the gear spindle turns the worm gear or other gear system. As gears of gear system 282 rotate, ring 200 begins to rotate in a direction 294, preferably ring 200 rotates at least partially within channel 160. In another embodiment, when system 100 has a plurality of rings 200, rings 200 may rotate together such that the plurality of struts 110 also rotate substantially simultaneously in the same direction.

In one embodiment, as ring 200 and/or bearings 164 rotate around external surface 123 of hull 12, struts 110 and ballast 114 also begin to move in substantially the same direction as ring 200. System 100 may rotate or cant to either starboard side 6 and/or port side 8.

Figure 18:
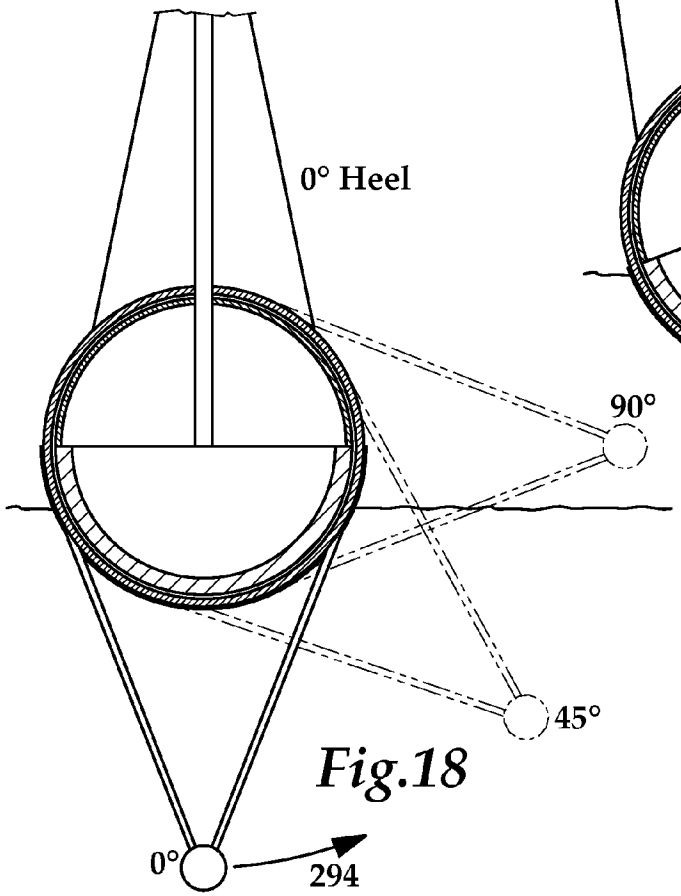
FIG. 18 is a cross-sectional view of a canted canting ballast system of FIG. 1.

In one embodiment, system 100 can cant up to about 90° to either starboard side 6 or port side 8. Because system 100 has such a wide range of rotation around hull 12, ballast 114 of system 100 may be canted in the water and may also be canted out of the water. For example, referring to FIG. 18, when boat heel is at about 0° and system 100 is canted to about 45°, ballast 114 of system 100 is canted in the water. However, continuing to refer to FIG. 18, when boat heel is at about 0° and system 100 is canted to about 90°, ballast 114 of system 100 is canted out of the water. For another example, now referring to FIG. 19, when boat heel is at about 20° and system 100 is canted to about 45°, ballast 114 of system 100 is canted in the water. However, continuing to refer to FIG. 19, when boat heel is at 20° and system 100 is canted to about 70°, ballast 114 of system 100 is canted out of the water.

Returning to FIG. 18, in one embodiment, when boat heel is about 0° and system 100 canted at 45°, the righting moment of system 100 may be about 20% higher than that of a traditional canting ballast system for the same parameters such as beam, draft, ballast, and canoe body draft. Moreover, in one embodiment, when boat heel is about 0° and system 100 canted at 90°, the righting moment of system 100 may be about 88% higher than that of a traditional canting ballast system for the same parameters such as beam, draft, ballast, and canoe body draft.

Figure 19:
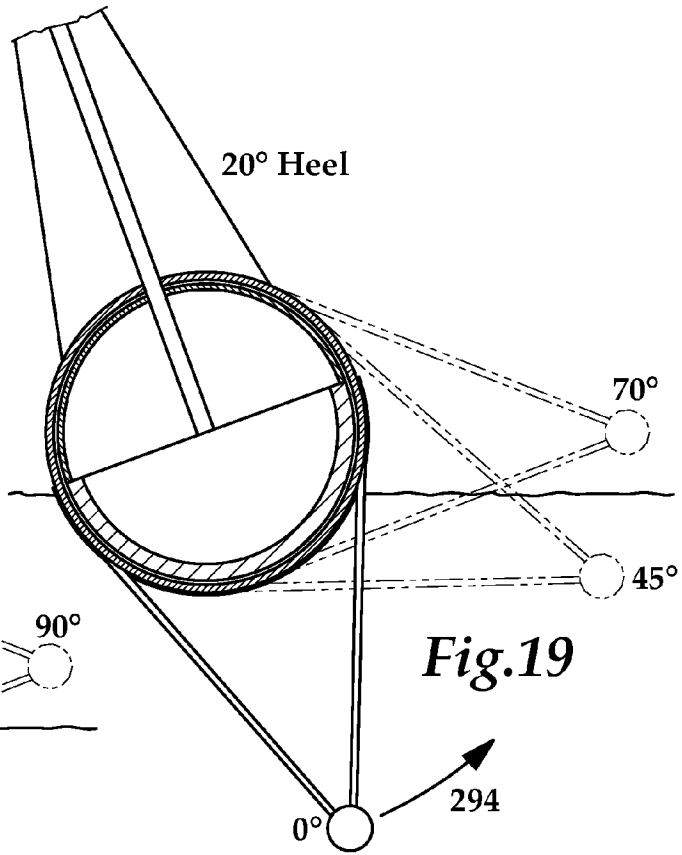
FIG. 19 is a cross-sectional view of another canted canting ballast system of FIG. 1.

Turning to FIG. 19, in one embodiment, when boat heel is about 20° and system 100 canted at 45°, the righting moment of system 100 may be about 29% higher than that of a traditional canting ballast system for the same parameters such as beam, draft, ballast, and canoe body draft. Moreover, in one embodiment, when boat heel is about 20° and system 100 canted at 70°, the righting moment of system 100 may be about 56% higher than that of a traditional canting ballast system for the same parameters such as beam, draft, ballast, and canoe body draft.

Control system 450 controls and optimizes rotation of system 100 for optimal performance both in straight line sailing and through tracking and gibing maneuvers. Control system 450 may be entirely manually controlled and operated, entirely automatically controlled and operated, and/or semi-automatically controlled and operated. If system 450 were entirely automatically controlled or semi-automatically controlled, a computer and/or computer system (not shown) coupled to system 450 operates and controls the rotation of system 100 to maximize performance, comfort, safety, and/or other criteria chosen by the operator such as heel angle, rudder angle, ballast position, wind strength, wind direction, bearing, sail selection, sheeting angles for sails, boat speed and/or other predetermined parameters.

In one embodiment, when system 100 has pin-stop 216, pin-stop 216 facilitates selectively locking ring 200 in a predetermined position. When ring 200 is locked, ring 200 may not rotate. Moreover, in one embodiment, when system 100 has a frictional brake 219 may facilitate slowing and/or stopping the rotation of ring 200. Further, when ring 200 is stopped and/or locked, portions of system 100 may be removed for repair.

During sailing and canting, safety system 500 prevents over rotating system 100 and/or rotating system 100 in a direction opposite the intended direction. Safety system 500 may also include a computer control system (not shown) and/or a mechanical control (not shown) configured to control parameters such as shroud tension, actual canting angle, boat heel angle, wind strength, boat speed, sea state, sail selection and sheeting angles, and/or other data.

Turning to an embodiment when hull 12 has at least one wing 150, shown in FIG. 5, system 100 operates substantially similar to the embodiment described above. However, ring 200 rotates through wing 150. Rotating ring 200 through wing 150, limits the rotation of system 100 to less than about 90°.

Turning to another embodiment when a portion of ring 200 is fabricated from a substantially rigid material and a portion of ring 200 is fabricated from substantially flexible material, shown in FIGS. 5A and 5B, system 100 operates similar to the embodiments described herein. However, a drive system and/or pulleys 232 facilitates rotation of ring or rotatable member 200 from a first position shown in FIG. 5A to one of plurality of second positions shown in FIG. 5B. Also, rather than ring

200 rotating around an arcuate member 124 and hull 12, the substantially flexible portion ring 200 rotates around at least one pulley 232 and/or drive system and the substantially rigid portion rotates around substantially around hull 12.

Yacht 10 and system 100 described herein may improve longevity and efficiency of sailing yachts. Struts of the canting ballast system described herein may experience less bending and/or torsional fatigue. Further, loads on the canting mechanism and on the hull/structure may be reduced. System 100 also facilitates preventing water from entering into yacht 10 as system 100 couples to at least a portion of the outside of the hull, and no openings are defined within hull 12 and/or yacht 10 that would enable water to leak into yacht 10. Canting ballast system 100 described herein is a relatively simple design wherein ballast 114 of system 100 may be canted out of the water which may improve the performance of yacht 10.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A sailboat comprising:

a hull having a port side and a starboard side, and an external surface;

an arcuate member coupled to said starboard and port sides extending above said hull; and a canting ballast system comprising:

at least one rotatable member coupled to said external surface and to said arcuate member;

a first strut having a first end and a second end;

a second strut having a first end and a second end, said first ends are coupled to said rotatable member; and at least one ballast, said second ends are coupled to said ballast such that an angle is defined between said first and second struts; and at least one drive system coupled to said canting ballast system wherein said at least one drive system is configured to rotate said canting ballast system with respect to said hull.

2. A sailboat according to claim 1, wherein at least one bearing is coupled between said hull and said at least one rotatable member.

3. A sailboat according to claim 2 further comprising a channel defined within a portion of said hull configured to receive at least a portion of said at least one rotatable member and said at least one bearing.

4. A sailboat according to claim 2, wherein said at least one bearing is at least one of a simple bearing, ball bearing, needle bearing, and roller bearing.

5. A sailboat according to claim 1, wherein said hull further comprises at least one wing.

6. A sailboat according to claim 1 further comprising a frictional brake coupled to said arcuate member.

7. A sailboat according to claim 1 further comprising a pin stop coupled to said arcuate member.

8. A sailboat according to claim 1, wherein said hull further comprises at least one foil.

9. A sailboat according to claim 1 further comprising at least one of a safety system, a position indication system, and a control system.

10. A sailboat comprising:

a hull having a port side and a starboard side, and an external surface;

an arcuate member coupled to said starboard and port sides extending above said hull; and a canting ballast system comprising:

at least one rotatable member coupled to said external surface and to said arcuate member;

a first strut coupled to said rotatable member at a first junction and a second strut coupled to said rotatable member at a second junction wherein a first distance is defined between said first and second junctions; and at least one ballast, said first strut is coupled to said at least one ballast at a third junction and said second strut is coupled to said at least one ballast at a fourth junction wherein a second distance is defined between said third and fourth junctions, said first distance is greater than said second distance; and at least one drive system coupled to said canting ballast system wherein said at least one drive system is configured to rotate said canting ballast system with respect to said hull.

11. A sailboat according to claim 10, wherein each said strut has a length that is greater than said first distance.

12. A sailboat comprising:

a hull having a port side and a starboard side, and an external surface;

an arcuate member coupled to said starboard and port sides extending above said hull; and a canting ballast system comprising:

a first rotatable member coupled to said external surface and to said arcuate member;

a second rotatable member coupled to said external surface and to said arcuate member;

a plurality of struts wherein each strut has a first end and a second end; and at least one ballast, wherein each said first end is coupled to at least one of said first and second rotatable members and wherein each of said second ends are coupled to said ballast; and at least one drive system coupled to said canting ballast system wherein said at least one drive system is configured to rotate said canting ballast system with respect to said hull.

13. A sailboat according to claim 12, wherein said first rotatable member has a first radius and a second rotatable member has a second radius wherein said second radius is different from said first radius.

14. A sailboat according to claim 12, wherein said first rotatable member has a first radius and a second rotatable member has a second radius, wherein said second radius and said first radius are substantially the same.

* * * * *